US005842528A

United States Patent [19]

Johnson et al.

[11] Patent Number: 5,842,528

[45] Date of Patent: Dec. 1, 1998

[54] METHOD OF DRILLING AND COMPLETING WELLS

[76] Inventors: Michael H. Johnson, 6506 Allentown Dr., Spring, Tex. 77389; Daniel J. Turick, 8011 White Marsh Ct., Spring, Tex. 77379

[21] Appl. No.: 343,814

[22] Filed: Nov. 22, 1994

[51] Int. Cl.[6] ..... E21B 7/04; E21B 43/04; E21B 43/08; E21B 47/022

[52] U.S. Cl. ..... 175/45; 175/61; 175/41; 175/107; 166/278; 166/358; 166/296; 166/366

[58] Field of Search ..... 175/61, 45, 74, 175/75, 107; 166/278, 296, 358, 366

[56] References Cited

U.S. PATENT DOCUMENTS

| | | | |
|---|---|---|---|
| 1,279,783 | 12/1918 | Stirling . | |
| 1,974,667 | 12/1934 | Patten . | |
| 2,229,493 | 1/1941 | Croft et al. . | |
| 2,726,847 | 12/1955 | McCune et al. . | |
| 2,778,603 | 1/1957 | McCune et al. . | |
| 3,463,228 | 8/1969 | Hearn | 166/181 |
| 3,880,233 | 4/1975 | Muecke et al. | 166/205 |
| 4,202,411 | 5/1980 | Sharp et al. | 166/244 |
| 4,239,084 | 12/1980 | Sharp et al. | 166/278 |
| 4,270,619 | 6/1981 | Base | 175/61 |
| 4,335,788 | 6/1982 | Murphey et al. | 166/278 |
| 4,445,578 | 5/1984 | Millheim | 175/61 X |
| 4,544,041 | 10/1985 | Rinaldi | 175/57 |
| 4,651,837 | 3/1987 | Mayfield | 175/262 |
| 4,828,053 | 5/1989 | Maurer et al. | 175/107 X |
| 4,962,818 | 10/1990 | DeLucia | 175/107 X |
| 5,148,875 | 9/1992 | Karlsson et al. | 175/62 |
| 5,163,521 | 11/1992 | Pustanyk et al. | 175/107 X |
| 5,197,553 | 3/1993 | Leturno | 175/57 |
| 5,234,055 | 8/1993 | Cornette | 166/278 |
| 5,253,708 | 10/1993 | Alexander | 166/278 |
| 5,255,741 | 10/1993 | Alexander | 166/278 |
| 5,311,952 | 5/1994 | Eddison et al. | 175/107 X |
| 5,368,109 | 11/1994 | Pittard, Jr. et al. | 175/107 X |

*Primary Examiner*—Stephen J. Novosad
*Attorney, Agent, or Firm*—C. Dean Domingue

[57] ABSTRACT

A method and apparatus for drilling and completing a bore hole is disclosed. Generally, the method comprises the steps of positioning a workstring in the well, with the workstring having attached thereto a bottom hole assembly. The bottom hole assembly may contain a bit for rotary drilling a bore hole; and, a drilling motor, operably associated with the bit, for effecting rotation to said drilling means. The method further includes the steps of circulating a fluid in the workstring so that the motor effects rotation of the bit means; and, drilling the bore hole through a target reservoir. In one embodiment, the workstring string is a production string, and the production string is attached to an isolation safety valve member for isolating the well and the bore hole from pressure.

13 Claims, 6 Drawing Sheets

METHOD OF DRILLING AND COMPLETING WELLS

FIELD OF THE INVENTION

The present invention relates to drilling and completing of wells. In particular, but not by way of limitation, the invention relates to drilling and completing of hydrocarbon wells.

BACKGROUND OF THE INVENTION

In order to recover hydrocarbons, a well is drilled into the ground until a hydrocarbon reservoir is encountered. In the earlier days of oil and gas exploration, most well sites were located on shore, and the wells that were drilled were primarily vertical. As the search for larger hydrocarbon reservoirs continues, the exploration is now focusing on offshore locations and remote land sites. Further, many wells are being drilled and completed as highly deviated and horizontal wells for economical and logistical reasons.

In offshore waters, one type of installation includes use of a fixed platform wherein the legs of the platform are rigid and embedded into the sea floor. The fixed platform has been a very popular type of structure; however, as the search for reserves continues, oil and gas companies find themselves searching in offshore locations were the water depths may be as deep as 6,000'.

As regards land locations, the exploration, drilling and production are now taking place in remote locations that may include arctic regions, desert regions, or even the rain forest of Latin America. Regardless of the inland or offshore location of these rigs, the remote nature of their location and the necessary ancillary equipment and personnel that must follow, the rental rates for these rigs are very significant.

In offshore waters, traditional fixed platforms can not be placed in depths generally greater than 300'. Therefore, tension leg platforms, drilling ships or semi-submersible drilling vessels are being used to drill these deep water wells. Typically, this involves the drilling rig being placed on the ship or floater. A sub sea Blow Out Preventor stack (BOP) is then placed on the ocean floor. A riser is then connected from the sub-sea BOP to the drill floor. The bore hole can then be drilled.

Once the well has been drilled and a hydrocarbon reservoir has been encountered, the well is ready to be completed. Many sub-sea wells are completed as single satellite wells producing to a nearby platform. They are a means of producing field extremities that cannot be reached by directional drilling from an existing platform and where the economics do not justify the installation of one or more additional platforms. Some multi-well templates and piping manifolds have been installed that go beyond the satellite well concept.

While the governments have recognized the importance and the necessity of drilling and completing wells in remote locations, significant regulations exist for each phase of the drilling, completing, and producing operation. Thus, when a certain size drill string is substituted for a second size, or alternatively, for production tubing, operators will require the changing of the BOP ram members so that control of the well bore is always maintained. This is a crucial concern because control of the well bore is essential at all times.

When the operator is converting from the drilling phase to the completion phase, the BOP stack must be changed out to accommodate the different outer diameter sized work string—from drill pipe to a production string. Furthermore, during the actual completion phase, the production tubing must be manipulated in order to perform the necessary functions such as perforating, circulating, gravel packing and testing. According to established safety procedures mandated by operator rules and government regulations, it is necessary to change out the BOP rams during certain phases. The changing out of BOP rams can be a costly and time consuming practice. Day rates for drill ships and semi-submersible ships can be quite expensive, and during the procedure for changing out the rams, no other substantive operations can be accomplish.

In a typical offshore location, wherein the drilling rig is either a jack-up vessel or placed upon a fixed platform, the BOP is normally situated on the vessel or platform itself. Nevertheless, because of safety considerations and government regulations, the control of the well bore from blow-out is always of primary concern. Therefore, safety of the installation along with economically performing the operation has always been a need.

In order to minimize cost, several techniques have been employed with varying degrees of success. One technique has been to drill and case the well, and then immobilize the drilling rig. A replacement rig is then utilized to complete the well. The replacement rig may vary from a snubbing unit, coiled tubing unit, workover rig using smaller inner diameter pipe, and in some cases wire line. Thus, rather than completing the well with the more expensive rig, a less expensive rig is utilized. Therefore, there is a need to provide for a more cost effective means for drilling and completing wells in the exotic locations of the world.

SUMMARY OF THE INVENTION

A method of drilling, and then completing a bore hole from a cased hole well in a single trip is disclosed. The method comprises the steps of positioning a work string in the well, the work string having attached thereto a bottom hole assembly that will have attached thereto a bit means for drilling a bore hole. Also attached will be motor means, operably associated with the drilling means, for effecting rotation to the drilling means. The method includes circulating a fluid in the work string so that the motor means causes rotation of the bit means in order to drill the bore hole through a target reservoir.

In one embodiment of this device, the work string may be a production string which may be attached to an isolation safety means, such as a Christmas tree, for isolating the bore hole from reservoir pressure.

In yet another embodiment, the drilling means will contain: orienting means, operably connected to the motor, for determining the direction and location of the bit means and generating a signal in response thereto; logging means for evaluating the lithology of a subterranean reservoir and generating a signal in response thereto; and, non-rotating means, operably connected on one end to the drill string and on the second end to the motor, for imparting selective rotation to the drilling means.

In this embodiment, the steps of drilling the bore hole will comprise transmitting the signals from the orienting and logging means; then, plotting the path of the bit means in order to determine the location of the bit. Next, the bit means can be steered in response to the bit location such that the bit means is drilled through the target reservoir.

This device may also contain completing means for completing the well, which in one embodiment would be preventing means for preventing the production of a reservoir sand into the inner diameter of the work string, also referred to as screen means. The steps would then include positioning the screen adjacent the target reservoir; and, placing a gravel slurry in the annulus adjacent to the target reservoir. The preventing means may include a soluble compound, and which would require after having the preventing means in position, displacing an acid solution means for dissolving the soluble compound; and thereafter, placing the well on production.

This bottom hole assembly may also contain a nuclear source means for determining the nuclear properties of the subterranean reservoir, and therefore, a further step of retrieving the nuclear source means from the bottom hole assembly may be necessary.

An object of the present invention includes the capability of enhancing the productivity of the reservoir since the method of drilling and completing will allow for use of lighter, cleaner and environmentally safer drilling and completion fluids. Still yet another object includes utilizing smaller quantities of drilling fluids during the drilling and completion phase since the annular area is smaller.

Another object includes having the drilling and completion means connected to the production tubing so that the completion assembly may be drilled into place. Still yet another object includes drilling and completing directional and multi-bore wells faster, and more economical.

A feature includes employing a drilling bottom hole assembly that is selectively detachable to a work string. Still another feature includes the use of an attachment means that can attach, and detach, the bottom hole assembly to the work string at the option of the operator.

Still yet another feature includes the use of gravel packing means on the bottom hole assembly which will allow the gravel packing of the well after the screen is in place. Another feature includes employing the drilling bottom hole assembly and completion bottom hole assembly in tandem when the well is being drilled with the work string.

Yet another feature of this invention includes eliminating tripping in and out of the well the drill string and completion bottom hole assembly thereby saving valuable rig time. Another feature includes use of a soluble compound that surrounds the screen not allowing the screen to become clogged with impurities, and also allows for the drilling fluid to be circulated through the inner diameter of the bottom hole assembly and the fluid flow continues on the outer diameter of the bottom hole assembly. Yet another feature includes the optional use of wash pipe in the bottom hole assembly which is placed concentric with the screen means and can be used as the inner diameter flow path of the drilling fluid.

An advantage includes use of orienting means while drilling such that the operator can steer the bit into the planned trajectory. Another advantage includes use of logging means while drilling such that the operator can evaluate and coordinate the subterranean reservoirs and telemeter the data to the surface. Still yet another feature is that a significant portion of the well can be drilled and cased before encountering the target reservoir, and thus, it is possible to drill the majority of the well bore with environmentally sensitive fluids that can be lighter pounds per gallons. Still yet another advantage includes the ability to use completion fluids that contain fewer solids, and therefore, expose the formation to less formation damage thereby providing for a better completion.

Another advantage includes the ability to complete subsea wells without changing out the rams of the Blow Out Preventor stack since the work string may remain in place after drilling through the target reservoir. Still yet another advantage includes having a drilling bottom hole assembly attached to a production string such that the production string is drilled into the target reservoir, and the well can be placed on production without the necessity of pulling out of the hole and replacing the work string.

DESCRIPTION OF THE PREFERRED EMBODIMENTS

Figure 1:
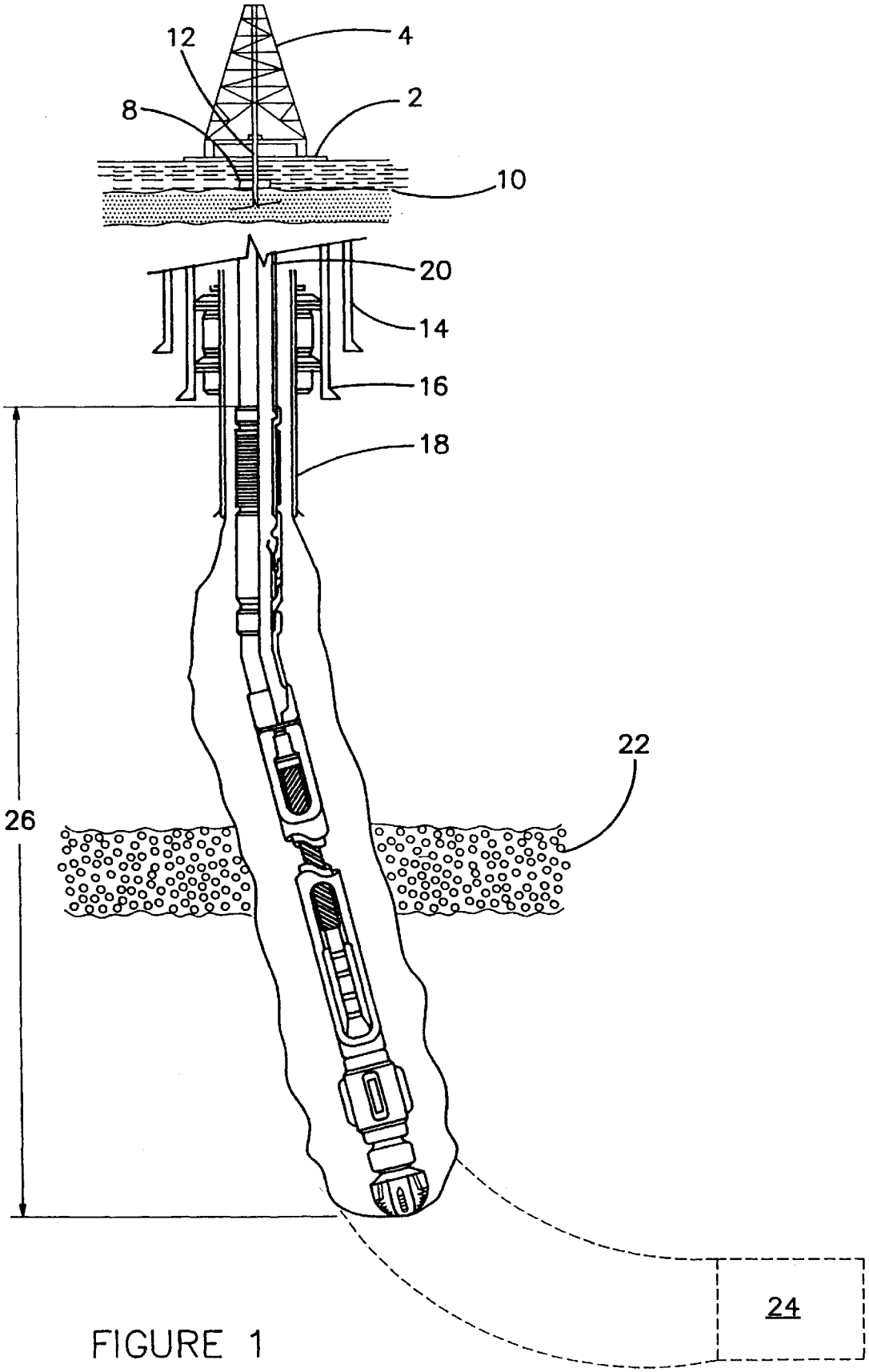
FIG. 1 is a semi-submersible drilling platform showing the drilling rig with casing and the target reservoir.

FIG. 1 depicts a semi-submersible drilling vessel 2 that has contained thereon a drilling rig 4. A sub-sea Blow-Out Preventor stack 8, also referred to as isolation safety means for isolating the well and the bore hole from pressure, is positioned on the ocean floor 10, with a riser 12 linking the sub-sea BOP stack 8 and the surface BOPs 6. Extending into the earth from the sub-sea stack 8 will be the well casings, including the conductor, surface, and intermediate 14, 16 and 18, respectfully.

As is well understood by those of ordinary skill in the art, the casing strings will intersect various subterranean reservoirs 22, some of which may contain hydrocarbons. As is shown in FIG. 1, a target reservoir 24 has yet to be drilled through. A work string 20 is positioned within the riser 12 and casing string 18. The string 20 has attached thereto a bottom hole assembly 26 containing a drilling means and sand control means, all of which will be discussed in detail hereafter. It should be noted that throughout the description of the preferred embodiments, like numbers used in the various figures refer to like components.

Figure 2:
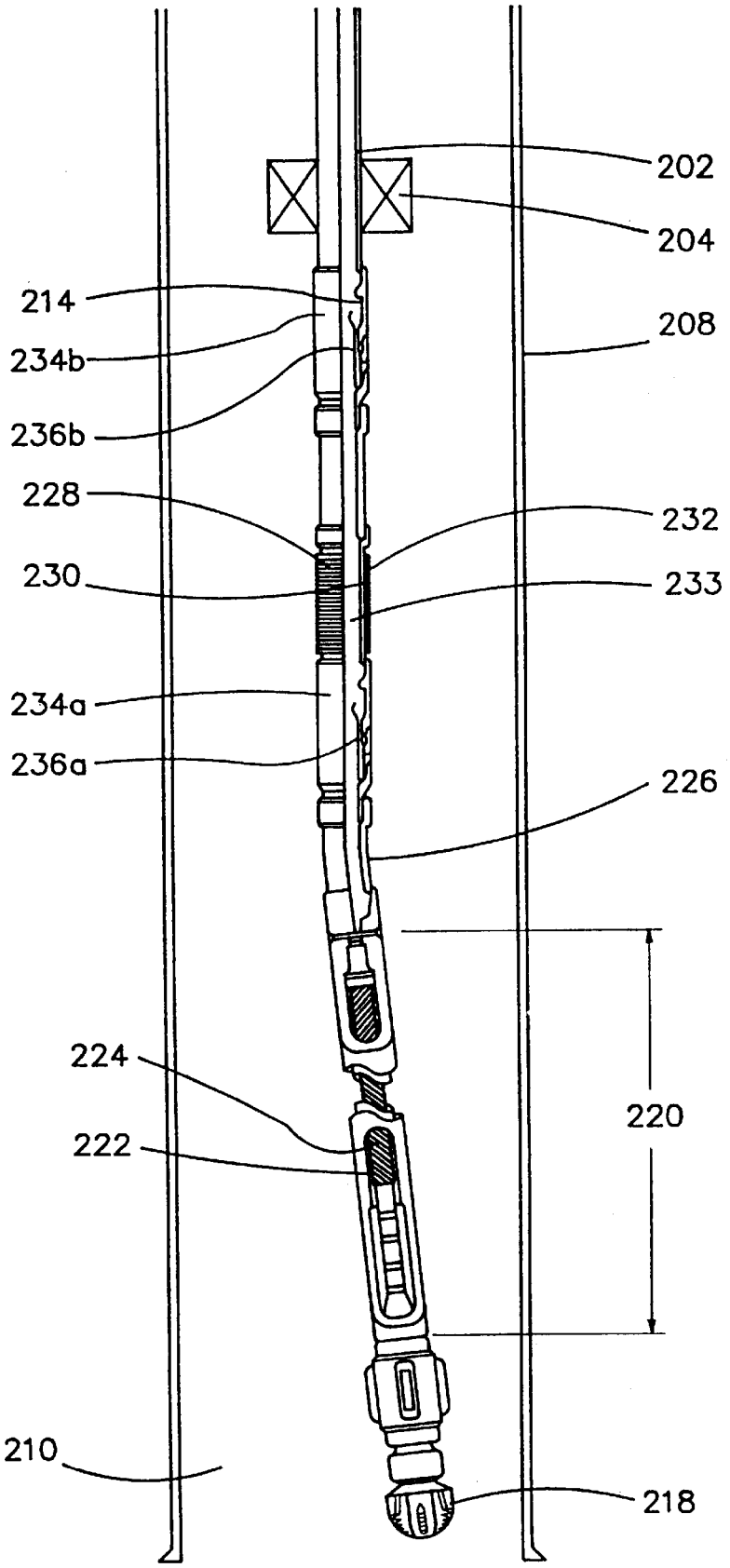
FIG. 2 shows a bottom hole assembly including drilling means and completion means in the casing.

Referring now to FIG. 2, the preferred embodiment of this invention which depicts the drilling and completing method and apparatus will now be described. In FIG. 2, the bottom hole assembly 26 will be attached to a work string 202. The work string 202 will contain a packer means 204 for sealingly engaging the casing string 206 so that an upper annulus 208 and lower annulus 210 is formed. The work string 202 may contain subsurface safety valve, and any other necessary nipple setting profiles 214.

The bottom hole assembly 200 will consist of bit means 218 for drilling a bore hole, with the bit means 218 depicted being a tri-cone rotating bit; however, it should be understood that other types of bit means, such as PDC bits may be employed. The assembly 26 will further consist of a motor means 220 for effecting rotation to the bit means 218, which in FIG. 2 is a stator 222 and rotor 224 assembly well known in the art.

The motor means 220 will in turn be connected to the deflection means 226 for causing a deflection in the bottom hole assembly so that the trajectory of the drilling path is curved. While a deflection means 226 has been shown, the teachings of this invention are certainly applicable to vertical hole completions. The deflection means 226 may be of the type where the angle of deflection is manipulated at the surface and run into the well bore, or alternatively, the deflection means 226, and in particularly the angle of deflection, is automatically controllable by transmitting a signal down hole by means of mud pulse, or acoustic telemetry. Alternately, the deflection means 226 may be controlled by a predetermined pressure force exerted on the deflection means 226 through either the inner diameter or outer diameter of deflection means 226.

The non-rotating swivel means (not shown) which is commercially available from Baker Hughes Incorporated and sold under the product name Model "A" Swivel performs the function of preventing relative rotation of the work string with respect to the threadedly engaging packer, thus assuring that the left hand packer threads of any production packers disposed on the production string cannot be disengaged during the necessary right hand rotation of the work string required to set or unset components of the bottom hole assembly during the drilling and placement of the sand control screen.

As seen in FIG. 2, the deflection means 226 will be attached to the means for preventing sand production 228, which in the embodiment shown is a sand control screen means in that there is a segment of perforated pipe 230 that has disposed about it a wire mesh screen 232. A soluble means, disposed about the sand control means 228, may be added for preventing the contamination of the sand control means from the drilling fluids and cuttings encountered during the drilling, placement, and completion of the well. Since the screen means 228 is porous, the soluble means can also serve the purpose of forming an impermeable barrier thereby allowing the circulation of the drilling fluid down the inner diameter of the workstring 202, out the bit means 218 and up the outer diameter of the workstring 202. The soluble means may be removed by acid treatments. The soluble means may be a wax composition; however, other types of compounds are available. The actual soluble means employed will depend on down hole temperature, and wellbore fluid composition.

Other types of preventing means can be employed such as a slotted liner well known in the art. The inner diameter of the sand preventing means 228, as well as the inner diameter of the remainder of the bottom hole assembly is denoted as 233. The detaching means 234*a* for detaching the preventing means 228 from the deflection means 226 and the remainder of the bottom hole assembly 200 is a releasable mechanism means that has contained thereon engaging collet members 236*a* that is well known in the art such as those devices used to release tubing conveyed perforating guns. The detaching means 234 is commercially available in the form of Mechanical and Hydraulic Release Subs from Baker Hughes Incorporated. A second detaching means 234*b* for detaching the work string 202 from the bottom hole assembly 200 is also shown, which has contained thereon engaging collet members 236*b*.

Figure 3:
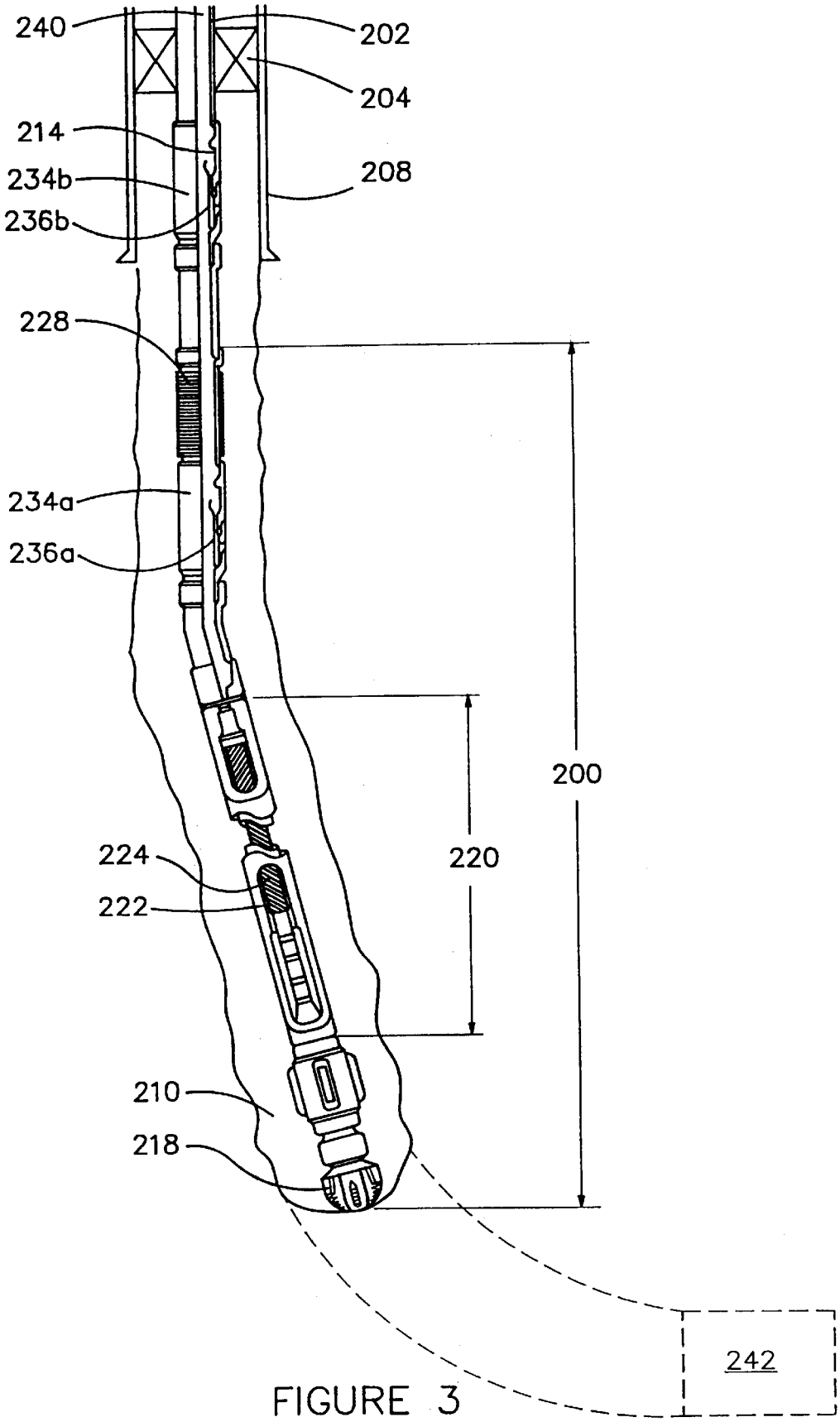
FIG. 3 shows the embodiment of FIG. 2 in the process of drilling a bore hole.

With reference to FIG. 3, the bottom hole assembly 26 is depicted wherein the bottom hole assembly 26 is in the process of drilling to a target reservoir 242. In the embodiment shown, the work string 202 is a production tubing string even though other types of conduits could be used such as coiled tubing.

Thus, for drilling to occur as shown in FIGS. 3, a drilling fluid is pumped down the inner diameter 240 of production tubing 202, through the inner diameter 233 of the sand control means, and into the motor means 220 thereby effecting rotation of the bit means 218. As can be seen, the production tubing 202 is the drilling conduit, and the cuttings and circulation of the drilling fluids follow the path of the annulus 208, 210 in the open hole section as well as the cased hole section.

While not depicted in the drawings, it is possible to include in the bottom hole assembly 200 an orienting means, operably associated with the motor, for determining the direction and location of the bit means and generating a signal in response thereto. Also, logging means for evaluating the lithology of a subterranean reservoir and generating a signal in response thereto, and non-rotating means, operably connected on one end to the drill string and on the second end to said motor, for imparting selective rotation to the bit means may also be included.

In order to drill and complete to the target reservoir 242, the procedure first comprises pumping a drilling fluid down the work string 202 thereby effecting rotation of the drilling means 218; next, orienting means and logging means will generate a representative signal, and that signal will be transmitted to the surface. The path of the bit means 218 may then be plotted in order to determine the location of the bit. The driller can then steer the bit means in response to the bit location, and ultimately drill through a target reservoir 242 with use of the bit means 218.

Figure 4:
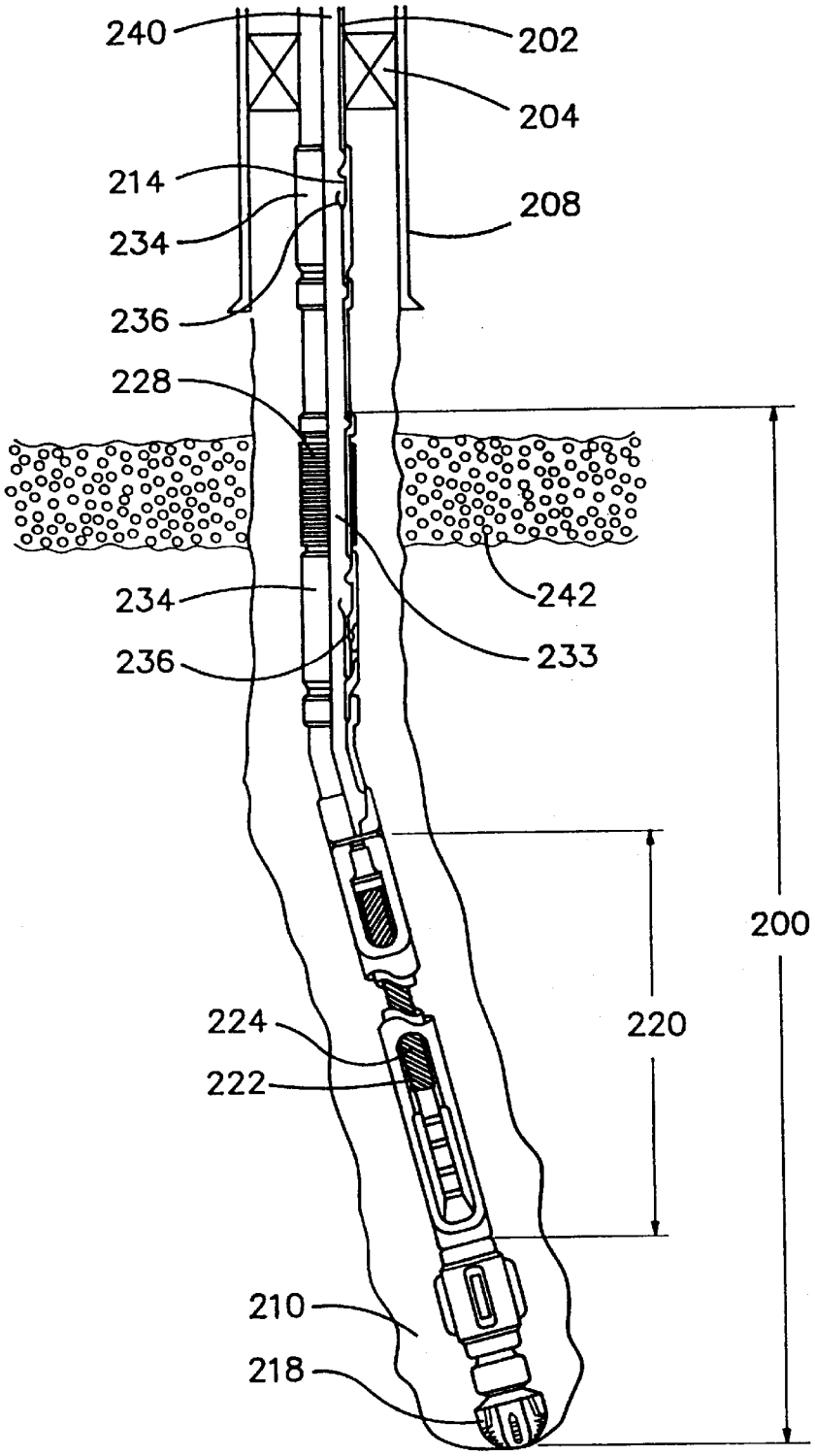
FIG. 4 shows the embodiment of FIG. 2 with the completion means adjacent the target reservoir.

FIG. 4 depicts a bore hole that has been drilled such that the target reservoir 242 has been encountered and the bore hole drilled to a sufficient depth so that the sand prevention means 228 is adjacent the target reservoir 242.

Figure 5:
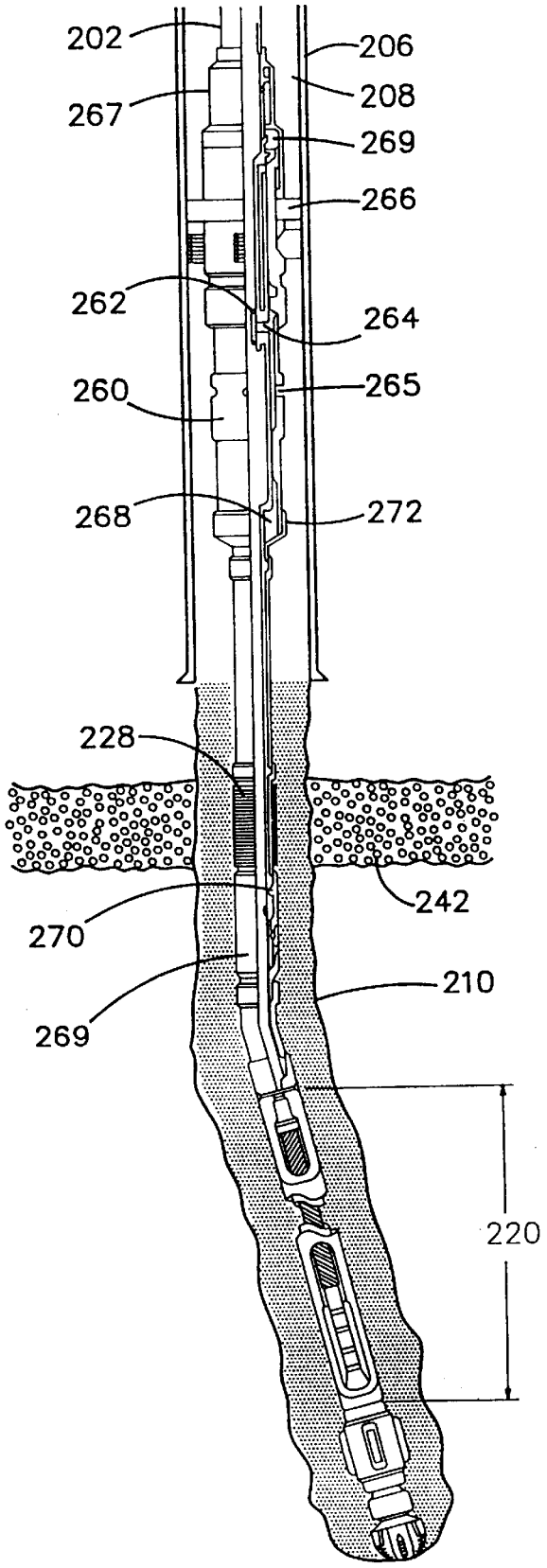
FIG. 5 shows one embodiment of the present invention used for placing a gravel slurry adjacent the target reservoir.

Referring to FIG. 5, the method and assembly of the present invention also provides for the placement of a gravel pack slurry in the annulus 210 adjacent the target reservoir 242. The workstring for this particular embodiment will contain the previously described bottom hole assembly 26 that includes the motor means 220, bit means 218, and the screen means 228. In order to place a gravel slurry into the annulus 210, it is also necessary that bottom hole assembly 200 also contain a gravel pack extension and crossover tool means 260 well known in the art and commercially available from Baker Hughes Incorporated under the trade name Model "S-2" Cross-Over, and the "S-1" Gravel Pack Extension.

The gravel pack extension and crossover tool means 260 will contain a sliding sleeve 262 that is slidable from a closed position to an open position, and is generally actuated by dropping a ball (not shown) from the surface, with the ball resting on the sliding sleeve 262. By pressuring up on the internal diameter of the work string, the ball will force the sleeve to an open position.

As seen in FIG. 5, the entire bottom hole assembly 26 is connected to a packer means 266 that will sealingly engage the casing string 206 so that an upper annulus 208 and a lower annulus 210 are formed. The packer means 266 will have operatively connected thereto a setting tool 267, with the associated wash pipe 268 extending therefrom, with the entire assembly being well known in the art and commercially available from Baker Hughes Incorporated under the trade name "SC" Setting Tool, or alternatively, the "BDP" Setting Tool may be used.

One of the functions of the wash pipe 268 is to serve as a conduit for the drilling fluid during the drilling phase. Thus, the path of the fluid during drilling is through the inner diameter of the work string 202, through the packer means 266, into the inner diameter of the wash pipe 268 and through the motor means 220 when the wash pipe 268 is used, it is not necessary to place the soluble compound about the screen 228.

The packer is released from the wash pipe and setting tool by rotating the workstring 202 so that the setting tool 267 and wash pipe 268 disengage by the disengagement via the threads at 269; thereafter, the setting tool 267 may be picked up which in turn lifts the wash pipe 268 which had been previously stung into the top of the motor means 220. The entire wash pipe assembly 268 is lifted up so that the end of the wash pipe 268 is adjacent the screen means 228 (not shown). In this position, the well can be gravel packed. As previously mentioned, the sliding sleeve 262 had been opened, thus, once the wash pipe is in the proper position, the gravel packing process may begin and the sand slurry is pumped down the inner diameter of the work string 202. The sand slurry exits into the annulus 210 at ports 264 and 265 into the annulus 210. The fluid of the sand slurry will be returned through the porous sand screen 228 and into the bottom of the wash pipe 268, and then up through the inner diameter of the wash pipe 268 and is ultimately crossed-over to the annulus 208. Once the necessary quantity of sand has been pumped, the workstring 202, setting tool 267 and wash pipe 268 can be removed from the wellbore. Afterwards, the production string is run into the wellbore, with the production string being stung into the top of the packer means 266. Hydrocarbons from the reservoir 242 may now be produced through the sand screen 228 and up the inner diameter of the production string.

Figure 6:
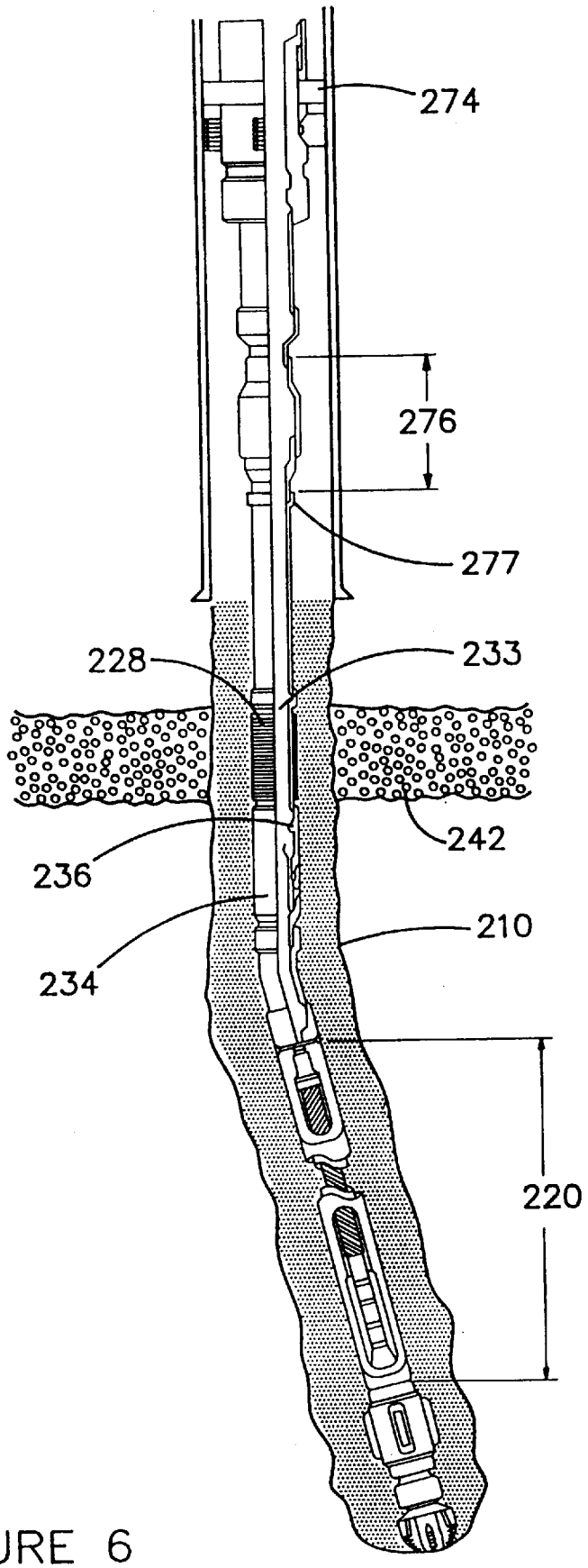
FIG. 6 shows a second embodiment of the present invention used for placing a gravel slurry adjacent the target reservoir.

Referring now to FIG. 6, an alternate embodiment of the present invention is depicted that can be used when gravel packing is desirable. The bottom hole assembly 26 including the screen 228, motor means 220 and bit means 218 is essentially the same as those depicted in FIGS. 2, 3, and 4. With the modifications to be described, it is now possible to circulate gravel pack the well annulus 210. Specifically, the embodiment of FIG. 6 depicts a production type of packer means 274 that will be connected to the production work string (not shown). The packer means 274 is commercially available from Baker Hughes Incorporated under the name Retrievable Hydraulic Set Packer. Extending downward from the production packer 274 will be the over shot means 276 for landing the packer means 274. The remainder of the bottom hole assembly 200 is identical to the bottom hole assembly 26 described in FIGS. 2, 3, and 4.

Thus, the procedure for drilling, completing and gravel packing the hydrocarbon reservoir 242 utilizing the embodiment of FIG. 6 would include drilling through the target reservoir 242 as previously described with the bottom hole assembly depicted in FIG. 3. Once the screen means 228 is adjacent the target reservoir 242, the annulus 210 can be gravel packed by circulating a gravel pack slurry down the annulus 208 and getting the fluid returns through the screen means 228. The reason for not placing the packer means 274 on the original bottom hole assembly is that the outer diameter of the packer means 274 is too large, and therefore, the gravel slurry could not be effectively placed down hole without the slurry bridging about the packer 274.

After placement of the gravel slurry, the work string is detached from the remainder of the bottom hole assembly 26 utilizing the detaching means **234*b* that is positioned above the screen means 228 as previously described in FIG. 3. As shown in FIG. 3, the detaching means 234*b* has contained thereon engaging collet members 236*b* that is well known in the art such as those devices used to release tubing conveyed perforating guns. The detaching means 234*b* also contains a nipple profile. The detaching means 234B is commercially available in the form of Mechanical and Hydraulic Release Subs from Baker Hughes Incorporated. The detaching means 234 is not shown in FIG. 6 since the assembly shown is after the detachment and removal of the workstring from the wellbore and the packer means 274** has been subsequently lowered into the wellbore on the production string.

Once the detaching means and work string have been pulled from the wellbore, the outer diameter nipple profile 277 with the rest of the bottom hole assembly 26 remains within the wellbore. Next, a production tubing string is run back into the wellbore, with the production tubing string having the previously mentioned packer means 274 and the over shot means 276 extending therefrom. The over shot 276 will be stung into and attach with the previously mentioned outer diameter nipple profile 277. Once the over shot is placed within the nipple profile 277, the packer means 274 is set against the casing string by hydraulic means such as pressuring up on the annulus. After the packer is set and an upper annulus 208 and lower annulus 210 is formed, the well may then be placed on production.

Changes and modifications in the specifically described embodiments can be carried out without departing from the scope of the invention which is intended to be limited only by the scope of the appended claims.

We claim:

1. A method of completing a bore hole from a cased hole well, the method comprising the steps of:

positioning a production string in the well, said production string having attached thereto a bottom hole assembly, said bottom hole assembly having a bit adapted for rotary drilling a bore hole; a motor, operably associated with said bit, adapted for effecting rotation to said bit; and an orienting device, operably connected to said motor, adapted for determining the direction and location of said bit and generating a signal in response thereto; a logging tool for evaluating the lithology of a subterranean reservoir and generating a signal in response thereto; non-rotating device, operably connected on one end to the production string and on the second end to said motor, for imparting selective rotation to said bit; and wherein said production string is attached to an isolation safety means for isolating the well and the bore hole from pressure;

circulating a fluid in said work string so that said motor effects rotation of said bit;

drilling the bore hole through a target reservoir;

and wherein the step of drilling the bore hole includes:

transmitting said signals from said orienting device and logging tool;

plotting the path of said bit in order to determine the location of said bit;

steering said bit in response to said bit location and drilling through said target reservoir.

2. The method of claim 1, wherein said bottom hole assembly further contains a completion assembly adapted for completing the well.

3. The method of claim 2, wherein the completion assembly contains a soluble compound for preventing the production of a reservoir sand into the inner diameter of the work string, and wherein the method further comprises:

positioning said completion assembly adjacent to the reservoir;

placing a gravel slurry in said well adjacent to the reservoir.

4. The method of claim 3 further comprising:

displacing an acid solution for dissolving said soluble compound;

placing the well on production.

5. The method of claim 4 wherein said bottom hole assembly further contains a nuclear source adapted for determining the nuclear properties of the subterranean reservoir, and wherein the step further comprises:

retrieving said nuclear source.

6. An assembly for completing to a target subterranean reservoir from a cased hole well, the assembly comprising:

a work string, attached to said assembly and concentrically located within the cased hole well, said work string having a packer adapted for sealingly engaging the casing string so that an upper annulus and a lower annulus is formed in said cased hole well;

a drilling device adapted for drilling a bore hole wherein said drilling device comprises:

a bit adapted for rotary drilling the bore hole;

a motor, operatively associated with said bit means, adapted for effecting rotation to said bit;

a completion assembly, attached to said drilling means, adapted for completing said target reservoir.

7. The assembly of claim 6, wherein said work string is a production string, and wherein said production string is attached to an isolation safety device adapted for isolating the cased hole and bore hole from the reservoir pressure.

8. The assembly of claim 7, wherein said drilling device further comprises:

an orienting device, operably connected to said motor, adapted for determining the direction and location of said bit and generating a signal in response thereto;

a logging tool, operably connected to said motor, adapted for evaluating a characteristic of a subterranean reservoir and generating a responsive signal thereto;

a non-rotating device, operably connected on one end of said production string and on the second end to said motor, adapted for imparting selective rotation to said drilling device.

9. The assembly of claim 8 wherein said completion assembly contains:

a sand control device adapted for preventing the flow of sand from the subterranean formation into the inner diameter of said production string;

a soluble compound, disposed about said sand control device, adapted for preventing the contamination of said sand control device from the drilling fluids and cuttings.

10. The assembly of claim 9 wherein said sand control device includes:

a gravel pack screen, said screen containing a first tubular member with a portion containing a plurality of openings, and disposed about said tubular member is a wire wrapped screen, said screen being placed in said bore hole so that an annulus is formed between said bore hole and said screen;

a cross-over member for the placement of a gravel slurry in the annulus of said bore hole.

11. A method of completing a well, the method comprising:

positioning a work string into the well, with said work string having attached thereto a bottom hole assembly, said bottom hole assembly containing:

a bit adapted for rotary drilling a bore hole; a motor, operably associated with said bit, adapted for effecting rotation to said bit; an orienting device, operably connected to said motor, adapted for determining the direction and location of said bit and generating a signal in response thereto; a logging device for evaluating the lithology of a subterranean reservoir and generating a signal in response thereto; and a completion assembly adapted for completing to a target reservoir;

and wherein the method further comprises:

circulating a fluid in said work string so that said motor effects rotation of said bit;

drilling a bore hole through the target reservoir.

12. The method of claim 11 wherein the step of drilling the bore hole comprises:

transmitting said signals from said orienting and logging devices;

plotting the path of said bit in order to determine the location of said bit;

steering said bit in response to said bit location;

drilling through said target reservoir with use of said bit.

13. The method of claim 12 wherein said completion assembly includes a soluble compound thereon, and wherein the method further comprises:

displacing an acid solution adapted for dissolving said soluble compound;

placing the well on production.

* * * * *